US005943026A

United States Patent [19]

Balthaser et al.

[11] Patent Number: 5,943,026

[45] Date of Patent: Aug. 24, 1999

[54] BOOT ASSEMBLY FOR AN ANTENNA

[75] Inventors: Andrew Dewitt Balthaser, Dauphin; Stephen Daniel Gherardini, Harrisburg; Richard Nicholas Whyne, Mechanicsburg, all of Pa.

[73] Assignee: The Whitaker Corporation, Wilmington, Del.

[21] Appl. No.: 09/195,480

[22] Filed: Nov. 18, 1998

Related U.S. Application Data

[60] Provisional application No. 60/066,236, Nov. 20, 1997.

[51] Int. Cl.[6] ..... H01Q 1/42

[52] U.S. Cl. ..... 343/872; 343/702; 343/715

[58] Field of Search ..... 343/702, 715, 343/900, 906, 872, 895

[56] References Cited

U.S. PATENT DOCUMENTS 4,375,642 3/1983 Dorrie et al. ..... 343/895
5,742,259 4/1998 Annamaa ..... 343/895
5,836,005 11/1998 Chang ..... 343/702
5,859,617 1/1999 Fujikawa ..... 343/702

*Primary Examiner*—Don Wong
*Assistant Examiner*—Kimnhung Nguyen
*Attorney, Agent, or Firm*—Katherine A. Nelson

[57] ABSTRACT

A boot assembly (40) for an antenna (30) includes an elongate sleeve (42) and an end cap (60), the sleeve (42) having an opening defining an annular recess (44) dimensioned to receive the end cap (60) and be secured thereto in an adhesive joint. One of either the inner surface (46) of the annular recess (44) or the outer surface (62) of the end cap (60) has axially extending ridges (48) and the other of the inner and outer surfaces (46, 62) has corresponding axially extending recesses (64) dimensioned to receive the ridges (48) therein. The inner and outer surfaces (46, 62) provide a large adhered surface area and multiple shear planes that distribute stress upon impact and minimizing propagation of cracks in the adhesive joint thereby maintaining the integrity of the sleeve (42) and end cap (60).

3 Claims, 3 Drawing Sheets

BOOT ASSEMBLY FOR AN ANTENNA

This application claims benefit of U.S. Provisional Application No. 60/066,236, filed Nov. 20, 1997.

FIELD OF THE INVENTION

This invention is directed to antennae and to a boot assembly for antennae.

BACKGROUND OF THE INVENTION

Antennae used for portable telephones, pagers, and the like typically are encased in a dielectric boot to protect the antenna from inadvertent contamination from moisture, dust, or the like. A boot assembly includes a sleeve dimensioned to receive the antenna therein with the leading end of the sleeve being closed and the other end being dimensioned to receive an end cap therein such that only a connector at the end of the antenna extends outwardly from the end cap for connection to the cellular telephone, pager, or the like. The boot and sleeve are typically secured together by means of an adhesive disposed at the joint therebetween.

Occasionally an electronic apparatus to which the antenna is attached may be dropped or otherwise subjected to impact which may cause the adhesive joint between the interior surface of the sleeve and the outer end cap to crack and to separate such that the antenna is no longer protected by the sleeve.

It is desirable, therefore, to provide a boot assembly for an antenna that maintains the integrity of the adhesive joint between the sleeve and end cap upon being subjected to impact. It is further desirable to provide a boot assembly in which the adhesive joint resists breakage when subjected to a torsional force.

SUMMARY OF THE INVENTION

The present invention is directed to a boot assembly for an antenna having an elongate sleeve and an end cap, the sleeve being open at a first end and closed at a second end. The sleeve is dimensioned to receive an antenna therein. The first end opening is an annular recess dimensioned to receive the end cap therein to hold the antenna in the sleeve. The inner surface of the sleeve and the outer surface of the end cap are secured at an adhesive joint therebetween. The assembly is characterized in that one of the inner surface of the annular recess and the outer surface of the end cap has axially extending ridges and the other of the inner and outer surfaces has corresponding axially extending recesses dimensioned to receive the ridges therein. The inner and outer surfaces provide a larger adhered surface area than the prior art antenna and multiple shear planes that distribute stress upon impact and minimize propagation of cracks in the adhesive joint thereby maintaining the integrity of the sleeve and end cap. The interlocking crenellated inner and outer surfaces furthermore resist breakage of the adhesive joint when the sleeve and cap are subjected to torsional force.

An embodiment will now be described by way of example with reference to the accompanying drawings.

DETAILED DESCRIPTION OF AN EMBODIMENT OF THE INVENTION

Figure 1:
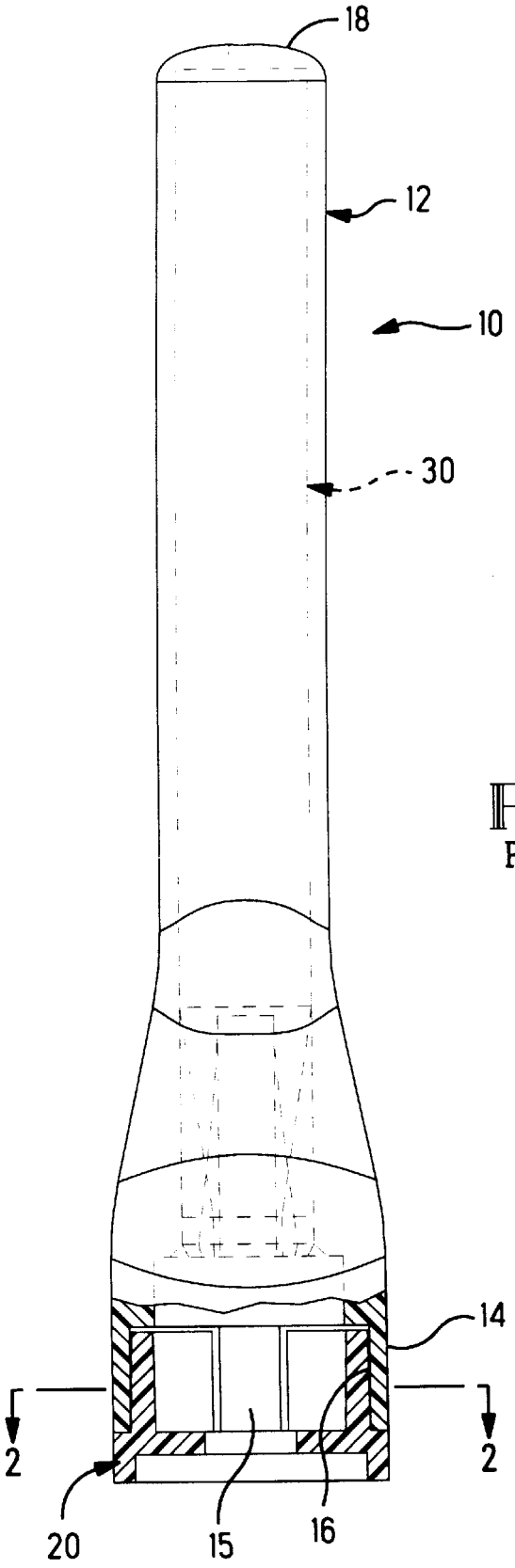
FIG. 1 Prior Art
FIG. 1 is a planar view of a prior art antenna boot assembly for an antenna with the antenna shown in phantom.
Figure 2:
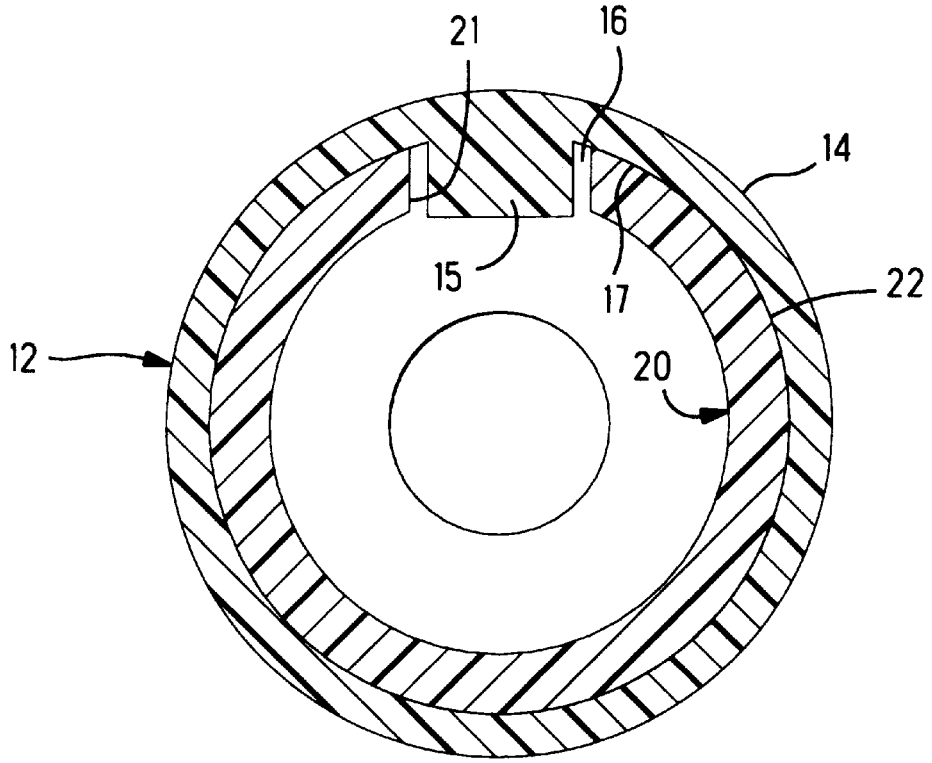
FIG. 2 Prior Art
FIG. 2 is a sectional view taken along the line 2—2 of FIG. 1.

Referring first to FIGS. 1 and 2, the prior art boot assembly 10 includes a sleeve 12 having a first open end 14 having an annular recess 16 and a second closed end 18 and an end cap 20 having an outside surface 22. Sleeve 12 is dimensioned to receive an antenna 30, shown in phantom, therein. The annular recess 16 of the sleeve 12 is dimensioned to receive the end cap 20 therein. The sleeve 12 and the cap 20 are aligned by use of a key 15 extending from the sleeve 12 and received in key-receiving notch 21 of cap 20, as best seen in FIG. 2. The sleeve 12 and cap 20 are secured together with an adhesive at a joint therebetween. For purpose of manufacturing the adhesive needs to be quick setting and provide good adherence between the sleeve and cap. Suitable adhesives include, for example, members of the cyanoacrylate family. As best seen in FIG. 2, the inner surface 17 of annular recess 16 and the outer surface 22 of end cap 20 are smooth. The smooth surface of the joint between the sleeve 12 and end cap 20 provides a continuous unbroken surface that allows cracks in the adhesive to propagate along the surface when the antenna is subjected to impact thus allowing the sleeve to separate from the end cap.

Figure 3:
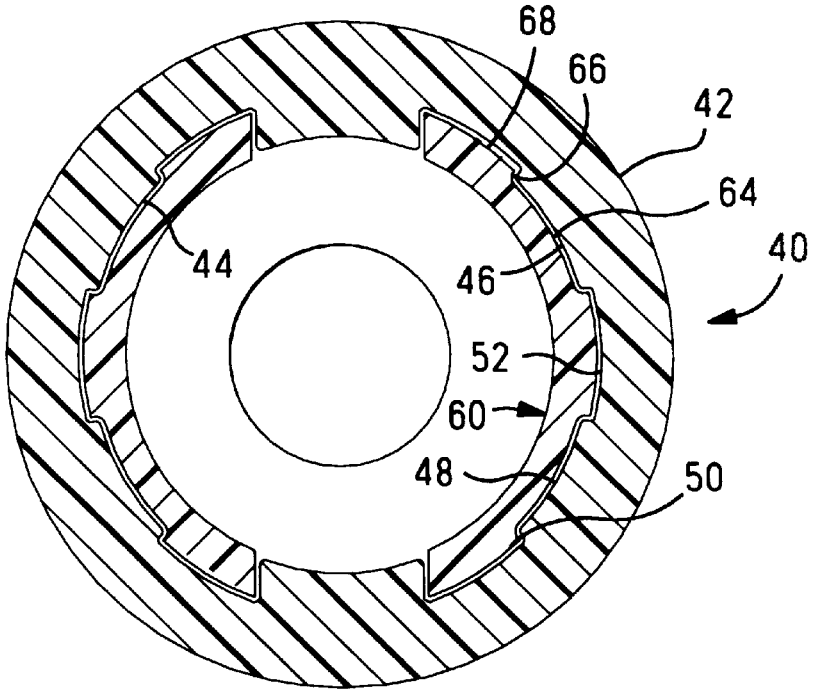
FIG. 3 is a sectional view similar to that of FIG. 2 showing a boot assembly made in accordance with the present invention.
Figure 4:
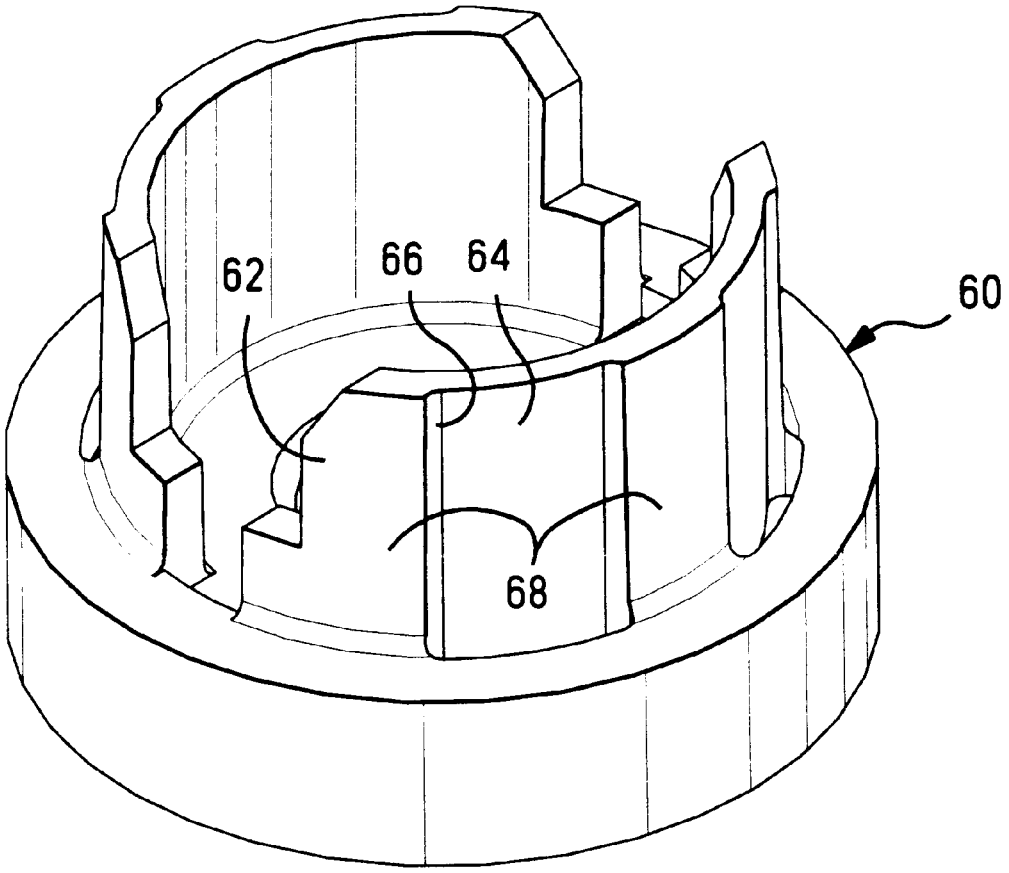
FIG. 4 is an isometric view of the end cap made in accordance with the invention.

Referring now to FIGS. 3 and 4, the boot assembly 40 of the present invention includes a sleeve 42 having essentially the same outer shape as that of the prior art. The sleeve 42 has an annular recess 44 at the open end thereof and a second closed end (not shown), and an end cap 60. The annular recess 44 has an inner surface 46 having a plurality of ridges 48 extending axially therealong defining a plurality of steps 50 and planes 52. The outside surface 62 of the cap 60 includes a plurality of axially extending recesses 64 defining a plurality of steps 66 and planes 68, as best seen in FIG. 4. Upon inserting the cap 60 into the annular recess 44 of sleeve 42, the ridges 48 are received in the corresponding recesses 64 forming an interlocking joint therebetween. The interlocking surfaces create multiple shear planes that prevent or minimize propagation of cracks when the boot assembly is subjected to impact thus improving the retention at the adhesive joint and preventing separation of the sleeve and end cap. Additionally the interlocking crenellated structure of the inner and outer surfaces resist breakage of the adhesive joint if the sleeve and end cap are subjected to a torsional force.

In the embodiment shown, the widths of the axially extending recesses and axially extending ridges are substantially the same. It is to be understood that the widths of the respective recesses and ridges may be different and the distance between adjacent ridges and recess may vary.

It is thought that the boot assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A boot assembly for an antenna including an elongate sleeve and an end cap, said sleeve having an opening at a first end and being closed at a second end, and being dimensioned to receive an antenna therein, said first end opening being an annular recess dimensioned to receive said end cap therein to hold said antenna in said sleeve, and an inner surface of said annular recess and an outer surface of said end cap being secured by an adhesive joint therebetween; the assembly being characterized in that:

one of said inner surface of said annular recess and said outer surface of said end cap having axially extending ridges and the other of said inner and outer surfaces having axially extending recesses dimensioned to receive said ridges therein, said inner and outer surfaces providing a large adhered surface area and multiple shear planes that distribute stress upon impact and minimize propagation of cracks in said adhesive joint, thereby maintaining the integrity of the adhesive joint between said sleeve and said end cap.

2. The boot assembly of claim 1 wherein each said ridge and each said recess has substantially the same width.

3. The boot assembly of claim 2 wherein adjacent ridges are spaced from each other by a width substantially equal to that of each said ridge and adjacent recesses are spaced from each other by a width substantially equal to that of each recess.

* * * * *